US010945531B2

(12) United States Patent
Topping

(10) Patent No.: US 10,945,531 B2
(45) Date of Patent: Mar. 16, 2021

(54) CUP HOLDER

(71) Applicant: Dana J. Topping, San Jose, CA (US)

(72) Inventor: Dana J. Topping, San Jose, CA (US)

( * ) Notice: Subject to any disclaimer, the term of this patent is extended or adjusted under 35 U.S.C. 154(b) by 0 days.

(21) Appl. No.: 15/851,600

(22) Filed: Dec. 21, 2017

(65) Prior Publication Data

US 2019/0191884 A1 Jun. 27, 2019

(51) Int. Cl.
*A47C 7/62* (2006.01)
*A47C 21/00* (2006.01)

(52) U.S. Cl.
CPC ..... *A47C 7/62* (2013.01); *A47C 7/622* (2018.08); *A47C 7/624* (2018.08); *A47C 21/00* (2013.01)

(58) Field of Classification Search
CPC ..... A47C 7/622; A47C 7/626
USPC ..... 297/188.12, 188.08, 188.2, 188.18
See application file for complete search history.

(56) References Cited

U.S. PATENT DOCUMENTS 5,165,639 A * 11/1992 Knuppe ..... A47O 7/62 248/215
5,289,962 A * 3/1994 Tull ..... B60N 3/102 211/41.2
6,010,104 A * 1/2000 Hanson ..... A47O 1/16 248/309.1
6,371,428 B1 * 4/2002 Zorich ..... A47C 7/70 206/549
6,520,366 B1 * 2/2003 Bradley ..... A47G 19/065 220/23.2
9,016,651 B2 * 4/2015 Webb ..... A47G 23/0225 248/146
2012/0091155 A1 * 4/2012 Skopis ..... A47G 23/0208 220/737
2016/0242564 A1 * 8/2016 Cass ..... A47C 21/00

* cited by examiner

*Primary Examiner* — Kristina N Junge
(74) *Attorney, Agent, or Firm* — Fenwick & West LLP

(57) ABSTRACT

Disclosed is a beverage container holder comprising a holding portion elongated in a first direction and a stabilizing portion elongated in a second direction. The stabilizing portion is coupled to the holding portion. The second direction is different than the first direction. The holding portion includes an aperture that is configured to hold a beverage container. The stabilizing portion is configured to be placed below a seating surface of a furniture for sitting.

18 Claims, 18 Drawing Sheets

FIG. 4

FIG. 5

FIG. 6

FIG. 7

CUP HOLDER

BACKGROUND

1. Field of the Invention

This invention relates to the field of beverage holders and particularly to beverage holders for a seat.

2. Description of the Related Art

Cup holders are devices that are designed to hold a cup or other type of beverage container or vessel. Typical cup holders are built into certain objects such as the armrest in an automobile or a movie theater seat. These cup holders allow beverages to be securely held in close proximity to the owner of the beverage.

Common household furniture lack such receptacles designed specifically to house a beverage container. Instead, people usually place their beverage containers on a tabletop. For instance, while seating on a couch, people may place beverage containers on a coffee table that is located in front or on the side of the couch. In this scenario, to grab the beverage container, a drinker would have to reach forward or sideways, which may result in an inconvenience to the drinker. In other situations, where a tabletop is not ready available, people may place beverage containers on the floor, which increases the likelihood of the beverage container being tipped over and the contents being spilled.

SUMMARY

Disclosed is a removable beverage container holder for use with a seating surface that can be added and removed to the seating surface, permitting the removable beverage container holder to be added and removed to a variety of seating surfaces, including surfaces that were not designed for a beverage container holder. The beverage container holder may be added to the seating service, permitting a drinker to place a beverage in the container holder and enjoy the beverage while using the seating surface. Moreover, the beverage container holder increases the stability of the beverage container (e.g., by reducing the possibility of the beverage container from being toppled over compared to when the beverage container is placed on the floor).

The removable beverage container holder includes a first portion ("holding portion") including for holding a container and a second portion ("stabilizing portion") for stabilizing the beverage container holder with a seating surface. The first portion is elongated in a first direction and the second portion is elongated in a second direction. The second portion is coupled to the first portion. The second direction is different than the first direction. The first portion includes an aperture that is configured to hold a beverage container. The second portion is configured to be placed below a seating surface of a furniture for sitting. The second portion may also be placed above the seating surface of the furniture and below a seated user. When thus installed, the first portion may extend outwards from the seating surface to hold the beverage in the aperture, the second portion extending in the different direction may provide stability to the beverage container holder to prevent the first portion from turning or tilting under the weight of the container and spilling the beverage. In addition, when the beverage container holder is below the user, it effectively holds beverages without interfering with objects next to the seating surface, such as another seating surface of the furniture (e.g., another cushion), and does not require an armrest or other component to the side of the user for attachment.

The beverage container holder may further include a third portion ("second stabilizing portion") elongated in a third direction, different than the second direction. The third portion is coupled to the second portion at a first end of the second portion. Moreover, the second portion is coupled to the first portion at a second end of the second portion, opposite to the first end.

BRIEF DESCRIPTION OF DRAWINGS

The disclosed embodiments have other advantages and features which will be more readily apparent from the detailed description, the appended claims, and the accompanying figures (or drawings). A brief introduction of the figures is below.

Figures

FIG. 4 illustrates a left side view of the first embodiment of a cup holder.

FIG. 5 illustrates a right side view of the first embodiment of a cup holder.

FIG. 6 illustrates a front side view of the first embodiment of a cup holder.

FIG. 7 illustrates a rear side view of the first embodiment of a cup holder.

DETAILED DESCRIPTION

The Figures (FIGS.) and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Cup Holder

Figure 1A:
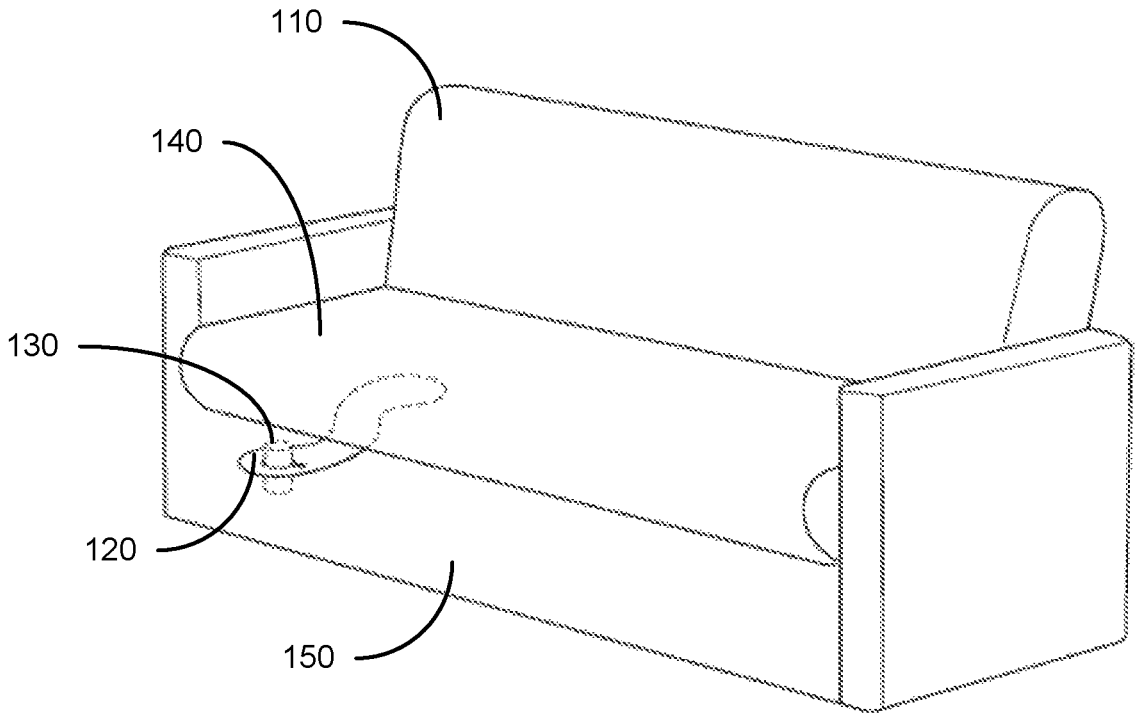
(FIGS. 1A-1C illustrates an environmental view of a cup holder, according to various embodiment.

FIG. 1A illustrates an environmental view of a cup holder, according to one embodiment. The environment in which a cup holder may be used includes a furniture 110 (e.g., a couch or sofa), a removable beverage cup holder 120, and a beverage container 130 (e.g., a cup). The furniture 110 includes a cushion 140 on which a person can sit or lay, and a frame 150 that holds the cushion 140. The cup holder is disposed between the frame 150 and the cushion 140 of the furniture 110. The cup holder includes an aperture to hold the beverage container 130. The cup holder is held in place by the weight of the cushion, in addition to a weight of a person sitting on the furniture 110.

Figure 1B:
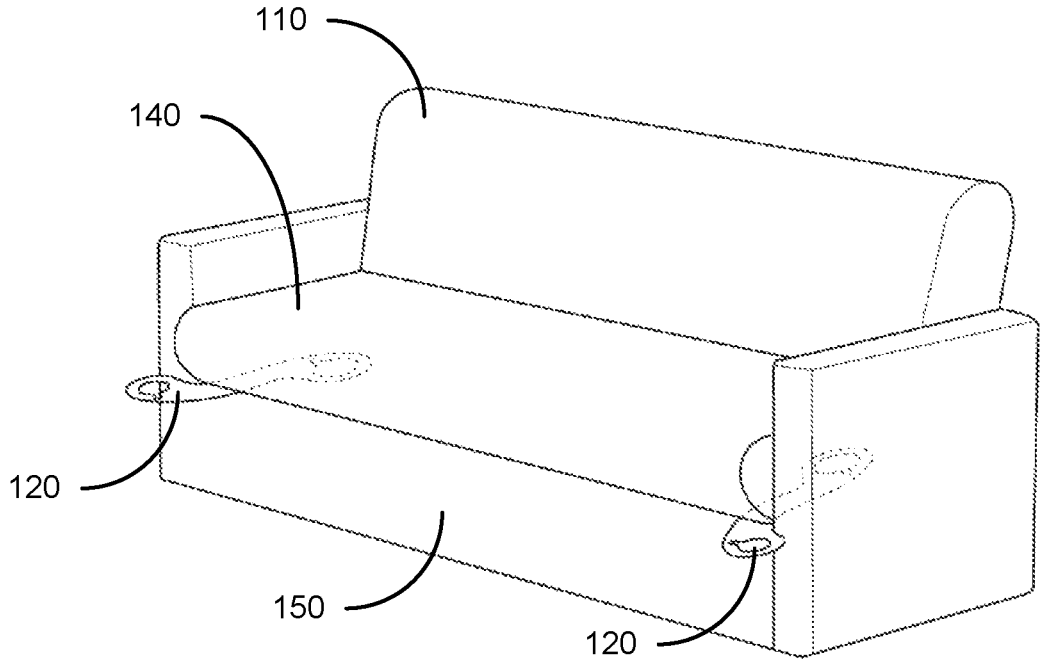

FIG. 1B illustrates an environmental view of the cup holder, according to another embodiment. As illustrated in FIG. 1B, the cup holder is shaped with a curved body (e.g., an "S" shaped body) that can wrap around the armrests of a couch or sofa. In this embodiment, the shape of the cup holder enables the cup holder to be outside of the sitting position. In one embodiment, the cup holder can be flipped over depending on whether a user of the cup holder would like the cup holder to wrap around the right armrest or the left armrest of the couch or sofa.

Figure 1C:
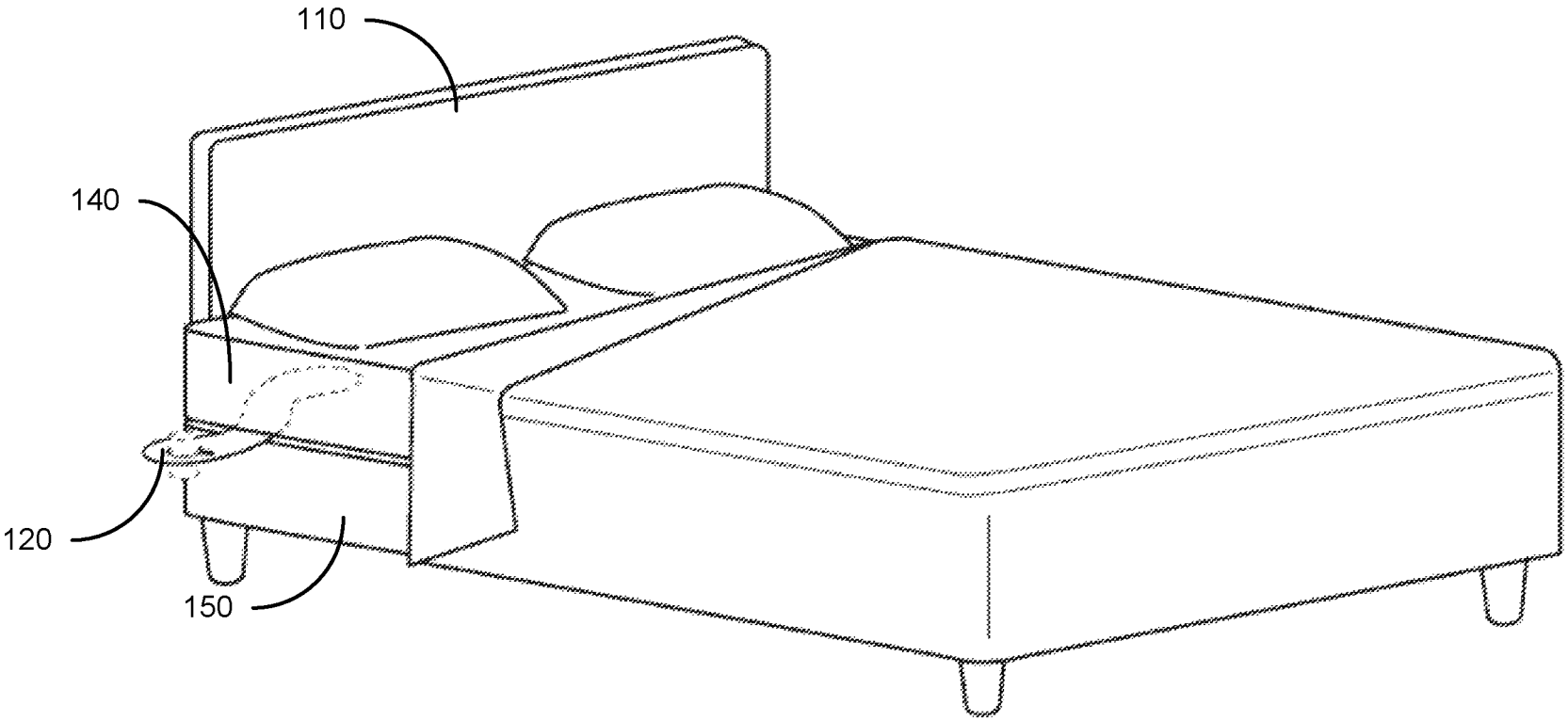

FIG. 1C illustrates a cup holder being used with a bed, according to one embodiment. In the embodiment of FIG. 1C, the frame 150 of the furniture 110 is the bed frame or a box spring, and the cushion 140 is the mattress of the bed. Thus, in the example of FIG. 1C, the cup holder 120 is disposed between the box spring and the mattress of the bed. In this example use of the cup holder, a person may be able to securely place a cup near the bed, when a nightstand or similar surface is not available or when placing the cup in a nightstand is not convenient. The use of the cup holder together with a bed may be beneficial for a variety setting including, but not limited to, hospital beds, elderly homes, or college dormitories.

Figure 2:
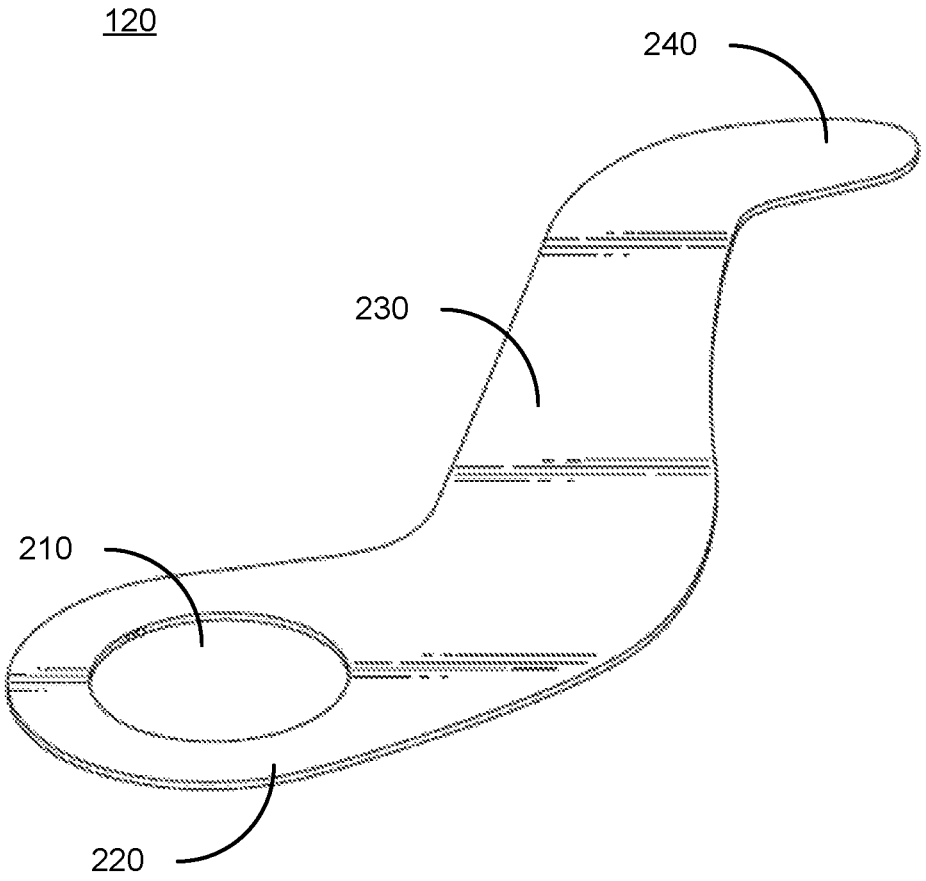
FIG. 2 illustrates a perspective view of a first embodiment of a cup holder.
Figure 3:
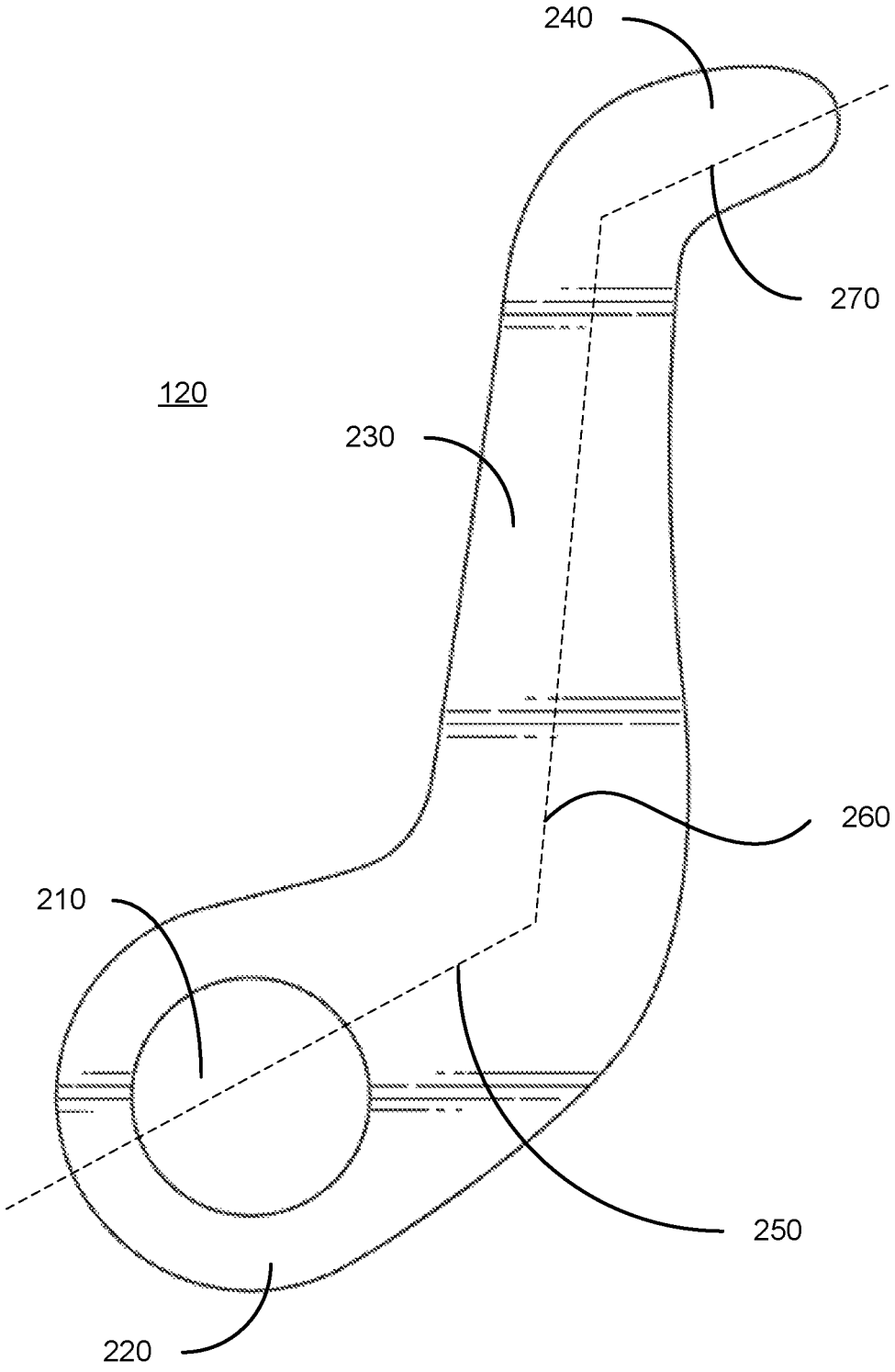
FIG. 3 illustrates a top view of the first embodiment of a cup holder.

FIG. 2 illustrates a perspective view of a first embodiment of a cup holder. FIG. 3 illustrates a top view of the first embodiment of a cup holder. FIG. 4 illustrates a left side view of the first embodiment of a cup holder. FIG. 5 illustrates a right side view of the first embodiment of a cup holder. FIG. 6 illustrates a front side view of the first embodiment of a cup holder.

The cup holder 120, according to the first embodiment, includes a first portion 220 elongated in a first direction 250, a second portion 230 elongated in a second direction 260, and a third portion 240 elongated in a third direction 270. The first portion includes an aperture 210 for holding a beverage container 130. This first portion with an aperture is termed a "holding portion" of the cup holder. In some embodiments, the aperture 210 is designed to hold a medium sized disposable cup. The aperture 210 has a circular shape with a diameter that matches the outer diameter of the middle section of a medium sized disposable cup.

The second portion 230 is attached to the holding portion 220. The second portion 230 is elongated in a second direction 260, which is different than the first direction 250. The second portion 230 may provide stability to the cup holder when in use with furniture, and is termed a "stabilizing portion." In some embodiments, the first direction 250 and the second direction 260 form an obtuse angle. The stabilizing portion 230 of the cup holder 120 is configured to slide between the frame 150 and the cushion 140 of the furniture 110. In some embodiments, the stabilizing portion 230 is flat and fabricated using a sturdy material. The edges of the second option 230 may also be rounded or narrowed to permit easier insertion between the frame 150 and the cushion 140. In one embodiment, the stabilizing portion 230 is made of a flexible or resilient material to prevent the stabilizing portion 230 from being broken due to excessive pressure exerted when a person sits on top of the cushion holding the cup holder. For instance, the stabilizing portion is fabricated using metal (e.g., steel or aluminium), hard plastic (e.g., polypropylene or polyethylene), or wood (e.g., recycled barrel oak). In some embodiments, the stabilizing portion 230 is fabricated using the same material as the holding portion 220. In one embodiment, the holding portion 220 and the stabilizing portion 230 are a unitary piece.

The third portion 240 is attached to the stabilizing portion 230. The third portion 240 is elongated in a third direction 270, which is different than the second direction 260. In some embodiments, the third direction 270 is parallel to the first direction 250. In other embodiments, the third direction 270 is different than both the first direction 250 and the second direction 260. In some embodiments, the third direction 270 and the second direction 260 form an obtuse angle. The third portion 240 may provide additional stability to the cup holder when in use with furniture, and is termed a "second stabilizing portion." The second stabilizing portion 240 is flat and fabricated using a sturdy material. In one embodiment, the material used to fabricate the second stabilizing portion 240 is also flexible to prevent the second stabilizing portion 240 from being broken due to excessive pressure exerted when a person is sitting on top of the cushion holding the cup holder. For instance, the second stabilizing portion is fabricated using metal or hard plastic. In some embodiments, the second stabilizing portion 240 is fabricated using the same material as the holding portion 220 and the stabilizing portion 230. In one embodiment, the holding portion 220, the stabilizing portion 230, and the second stabilizing portion 240 are a uniform body.

The second stabilizing portion 240 is configured to be placed between the frame 150 and the cushion 140 of furniture 110. The second stabilizing portion 240 is further configured to be position underneath a person when the person is sitting on the furniture 110, such that the weight of the person holds the cup holder 120 in place.

Since the cup holder typically is not attached to the furniture, the stabilizing portion 230 and the second stabilizing portion 240 provide additional stability to the cup holder when in use, preventing the weight of the cup when inserted in the holding portion from rotating or moving the cup holder.

Figure 8:
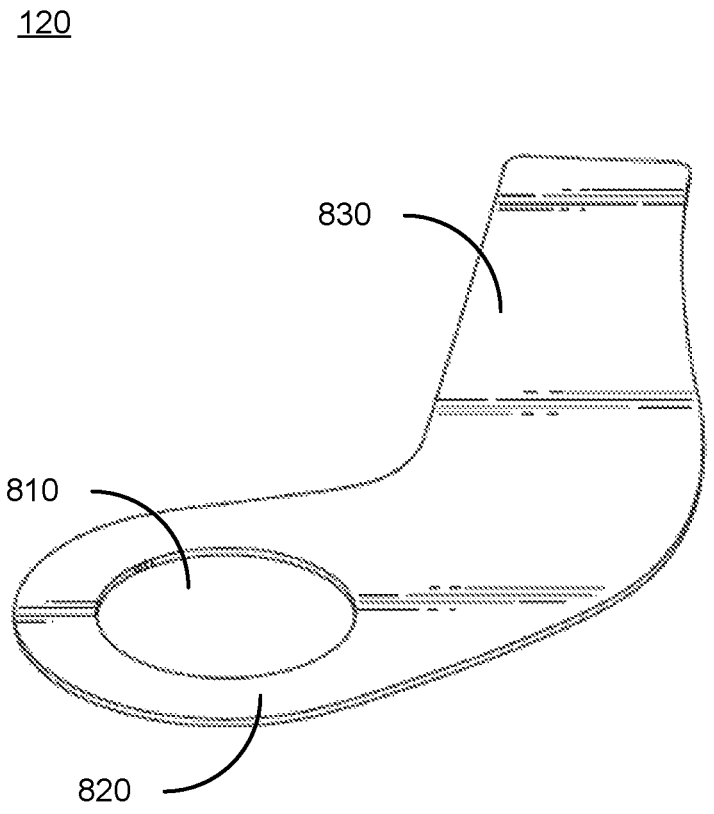
FIG. 8 illustrates a perspective view of a second embodiment of a cup holder.
Figure 9:
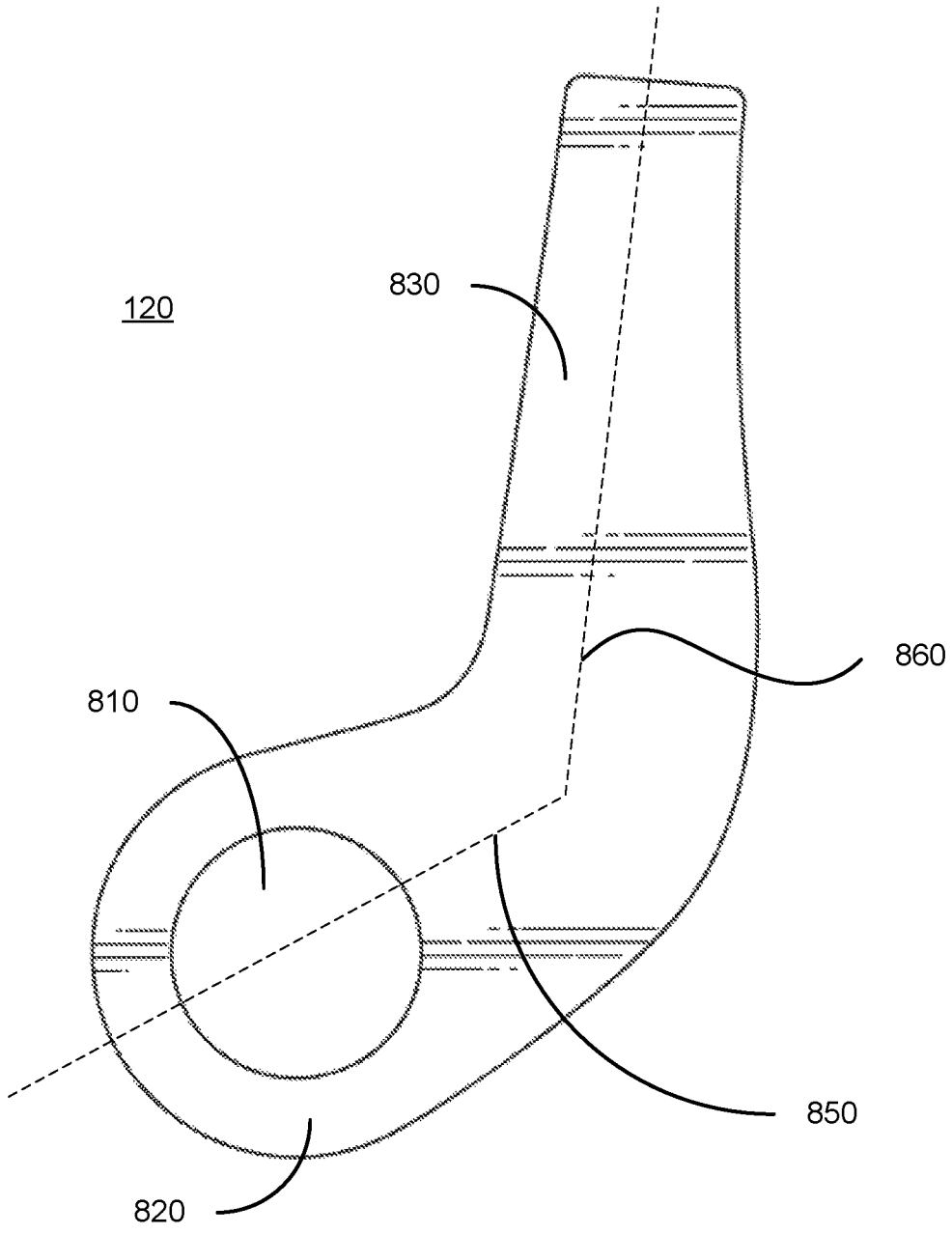
FIG. 9 illustrates a top view of the second embodiment of a cup holder.

FIG. 8 illustrates a perspective view of a second embodiment of a cup holder. FIG. 9 illustrates a top view of the second embodiment of a cup holder. The cup holder 120, according to the second embodiment, a holding portion 820, and a stabilizing portion 830. The holding portion 820 includes an aperture 810 for holding a beverage container 130. The holding portion 820 is elongated in a first direction 850. The stabilizing portion 830 is elongated in a second direction 860, different than the first direction 850. In some embodiments, the first direction 850 and the second direction 860 form an obtuse angle. The cup holder according to the second embodiment differs from the cup holder according to the first embodiment, in that the cup holder according to the second embodiment does not have the second stabilizing portion 240 elongated in a third direction. As such, the cup holder 120 according to the second embodiment may be made smaller than the cup holder according to the first embodiment.

When a person sits on top of cushion 140, the cushion 140 distributes the weight of the user throughout the bottom surface of the cushion 140. As such, even if cup holder 120 according to the second embodiment does not have a portion that is configured to be placed right under the person when the person is sitting on the furniture 110, the portion of the weight of the person that is distributed to the portion of the cushion 140 that is right above the stabilizing portion 830 of the cup holder 120 may prevent the cup holder 120 from moving or falling.

Figure 10:
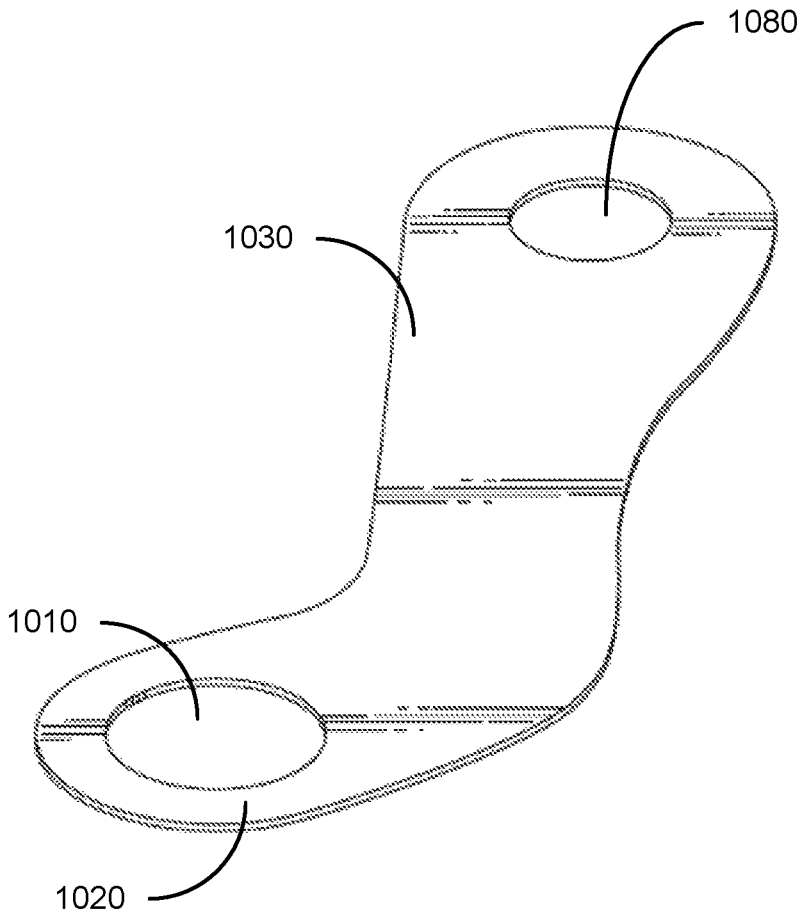
FIG. 10 illustrates a perspective view of a third embodiment of a cup holder.
Figure 11:
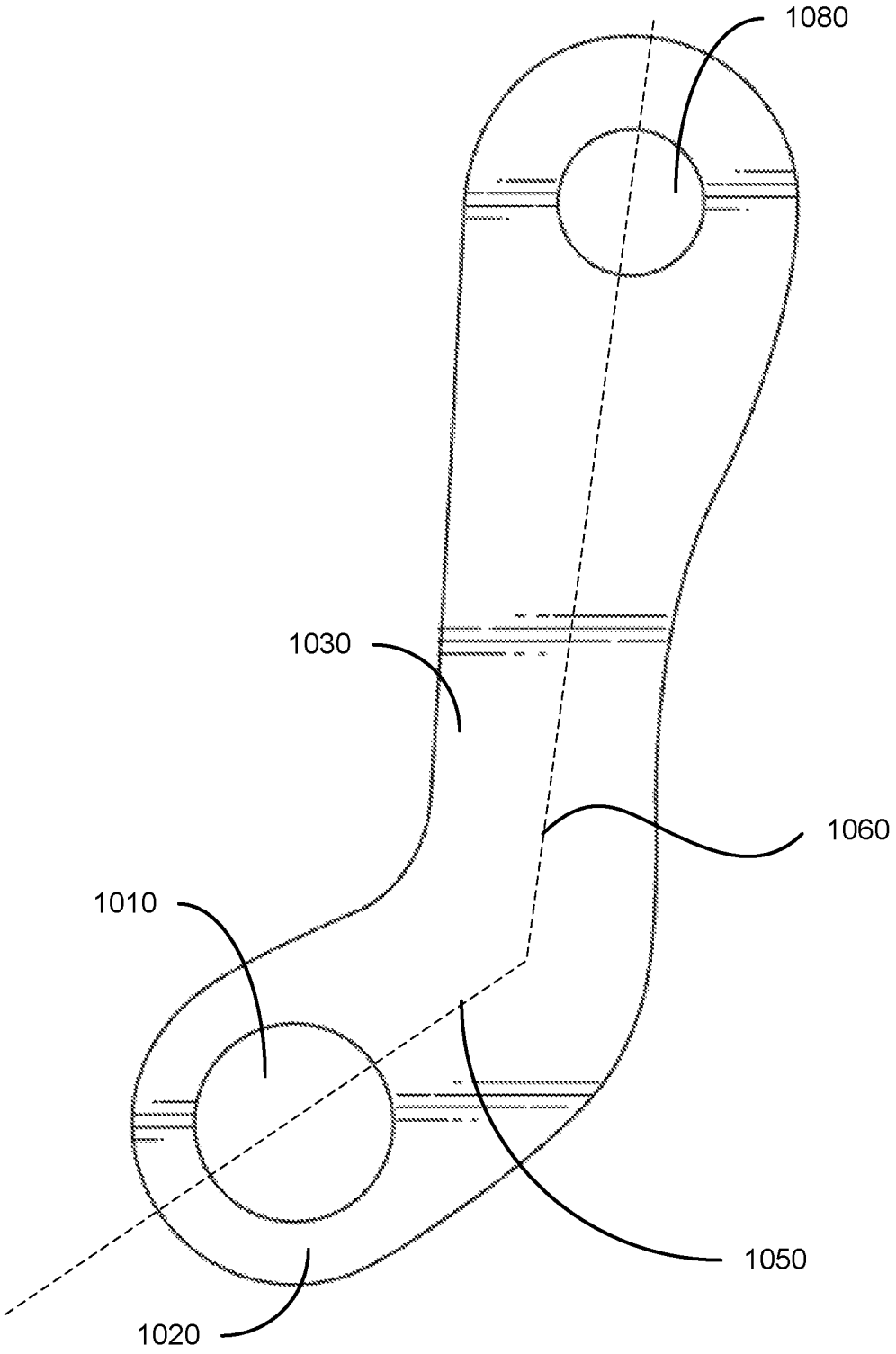
FIG. 11 illustrates a top view of the third embodiment of a cup holder.

FIG. 10 illustrates a perspective view of a third embodiment of a cup holder. FIG. 11 illustrates a top view of the third embodiment of a cup holder. The cup holder 120, according to the third embodiment, a holding portion 1020, and a stabilizing portion 1030. The holding portion 1020 includes a first aperture 1010 for holding a beverage container 130. The holding portion 1020 is elongated in a first direction 1050. The first aperture 1010 has a circular shape and is configured to hold beverage containers having a first size range.

The stabilizing portion 1030 includes a second aperture 1080 for holding a beverage container 130. The stabilizing portion 1030 is elongated in a second direction 1060, different than the first direction 1050. In some embodiments, the first direction 1050 and the second direction 1060 form an obtuse angle. The second aperture 1080 has a circular shape and is configured to hold beverage containers having a second size range, different than the first size range. That is, the second aperture 1080 has a different diameter than aperture 1010.

The stabilizing portion 1030 is configured to be placed between frame 150 and cushion 140 of furniture 110 when the cup holder is to be used to hold beverage containers having a size that is within the first size range. Furthermore, the holding portion 1020 is configured to be placed between frame 150 and cushion 140 of furniture 110 when the cup holder is to be used to hold beverage containers having a size that is within the second size range.

In some embodiments, the holding portion 1020 having the first aperture 1010 is shorter in length than the stabilizing portion 1030 having the second aperture 1080. In this embodiments, the first aperture 1010 has a larger diameter than the second aperture 1080. Thus, the first aperture 1010 is configured to hold a larger sized cup than the second aperture 1080. Thus, the longer stabilizing portion 1030 provides additional stability for when the cup holder is holding a larger and heavier cup.

Figure 12:
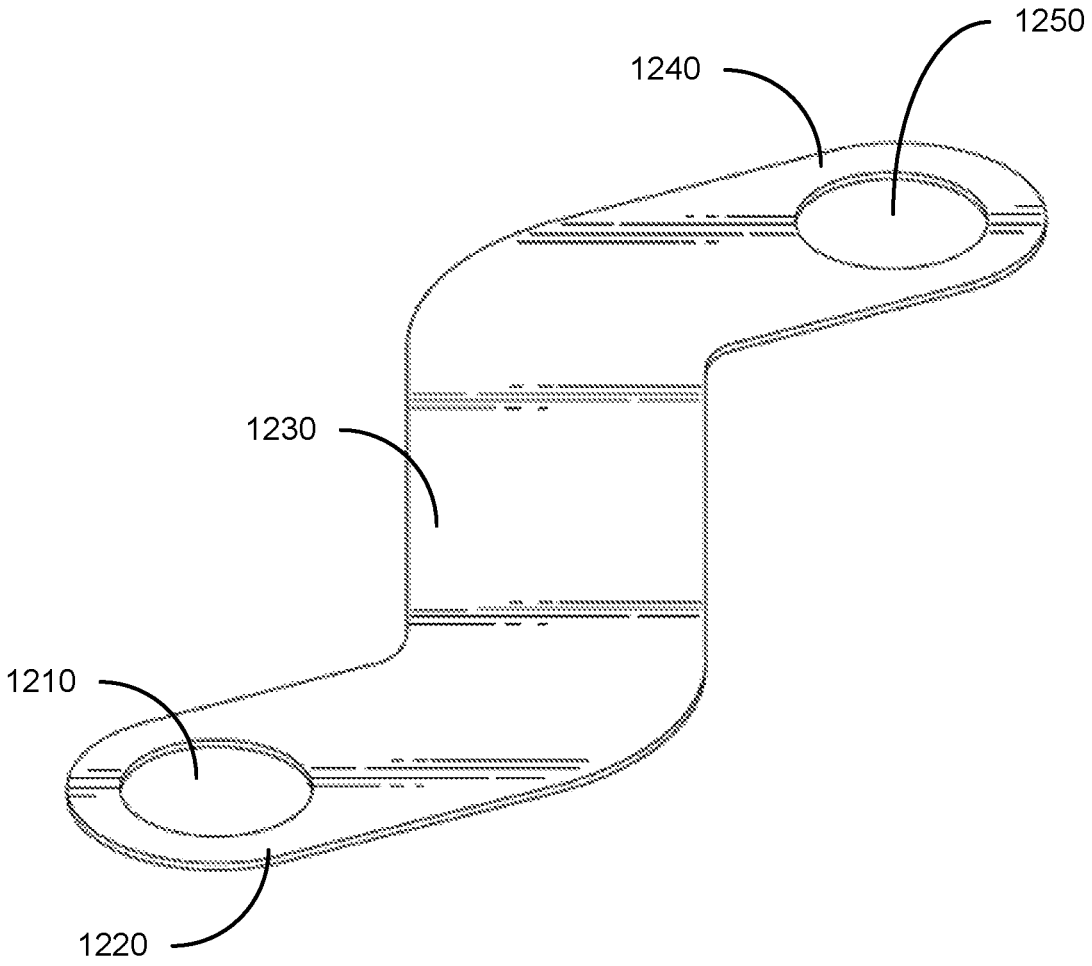
FIG. 12 illustrates a perspective view of a fourth embodiment of a cup holder.
Figure 13:
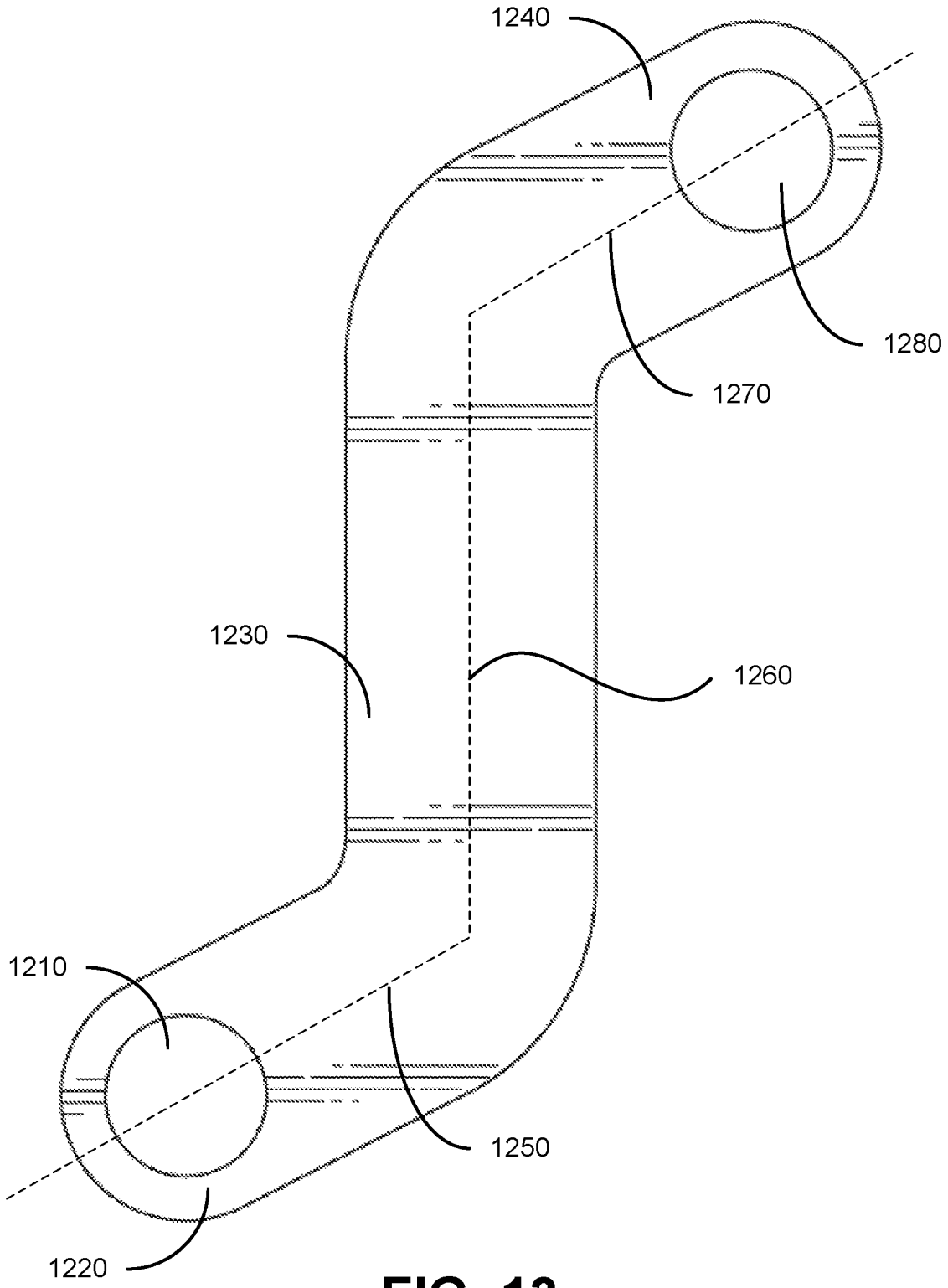
FIG. 13 illustrates a top view of the fourth embodiment of a cup holder.

FIG. 12 illustrates a perspective view of a fourth embodiment of a cup holder. FIG. 13 illustrates a top view of the fourth embodiment of a cup holder. The cup holder 120, according to the fourth embodiment, a holding portion 1220, and a stabilizing portion 1230, and a second stabilizing portion 1240. The holding portion 1220 includes a first aperture 1210 for holding a beverage container 130. The holding portion 1220 is elongated in a first direction 1250. The first aperture 1210 has a circular shape and is configured to hold beverage containers having a first size range.

The second stabilizing portion 1240 includes a second aperture 1208 for holding a beverage container 130. The second stabilizing portion 1240 is elongated in a third direction 1270. In some embodiments, the third direction 1270 is parallel to the first direction 1250. In other embodiments, the third direction 1270 is different oblique to the first direction 1250. The second aperture 1280 has a circular shape and is configured to hold beverage containers having a second size range, different than the first size range. That is, the second aperture 1280 has a different diameter than aperture 1210.

The stabilizing portion 1230 is coupled to the holding portion 1220 at a first end, and is coupled to the second stabilizing portion 1240 at a second end, opposite to the first end. The stabilizing portion 1230 is elongated in a second direction 1260. The second direction 1260 is different than both the first direction 1250 and the third direction 1270. In some embodiments, the first direction 1250 and the second direction 1260 form an obtuse angle. Moreover, the second direction 1260 and the third direction 1270 form an obtuse angle.

Figure 14:
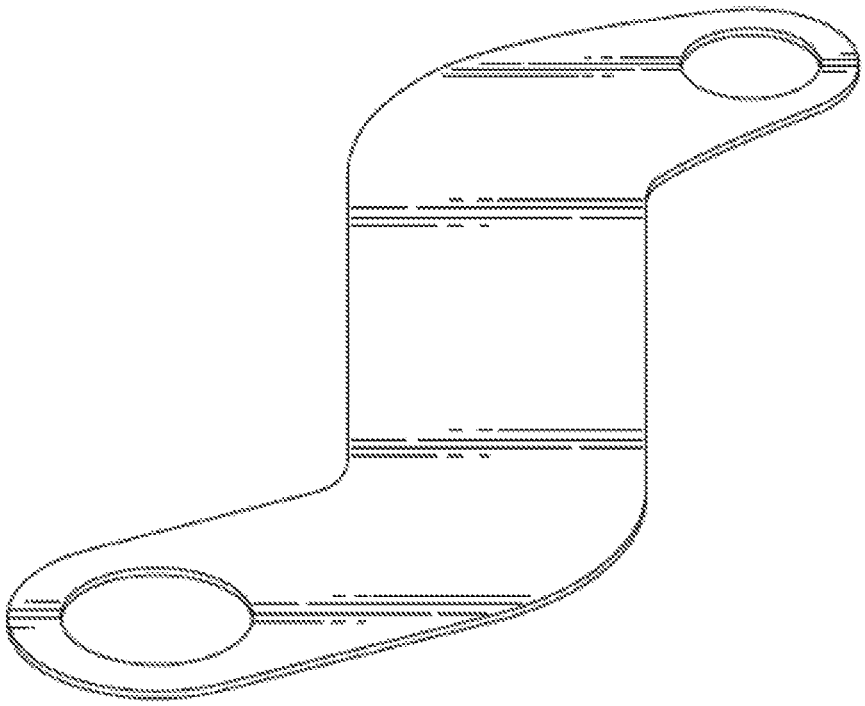
FIG. 14 illustrates a perspective view of a fifth embodiment of a cup holder.
Figure 15:
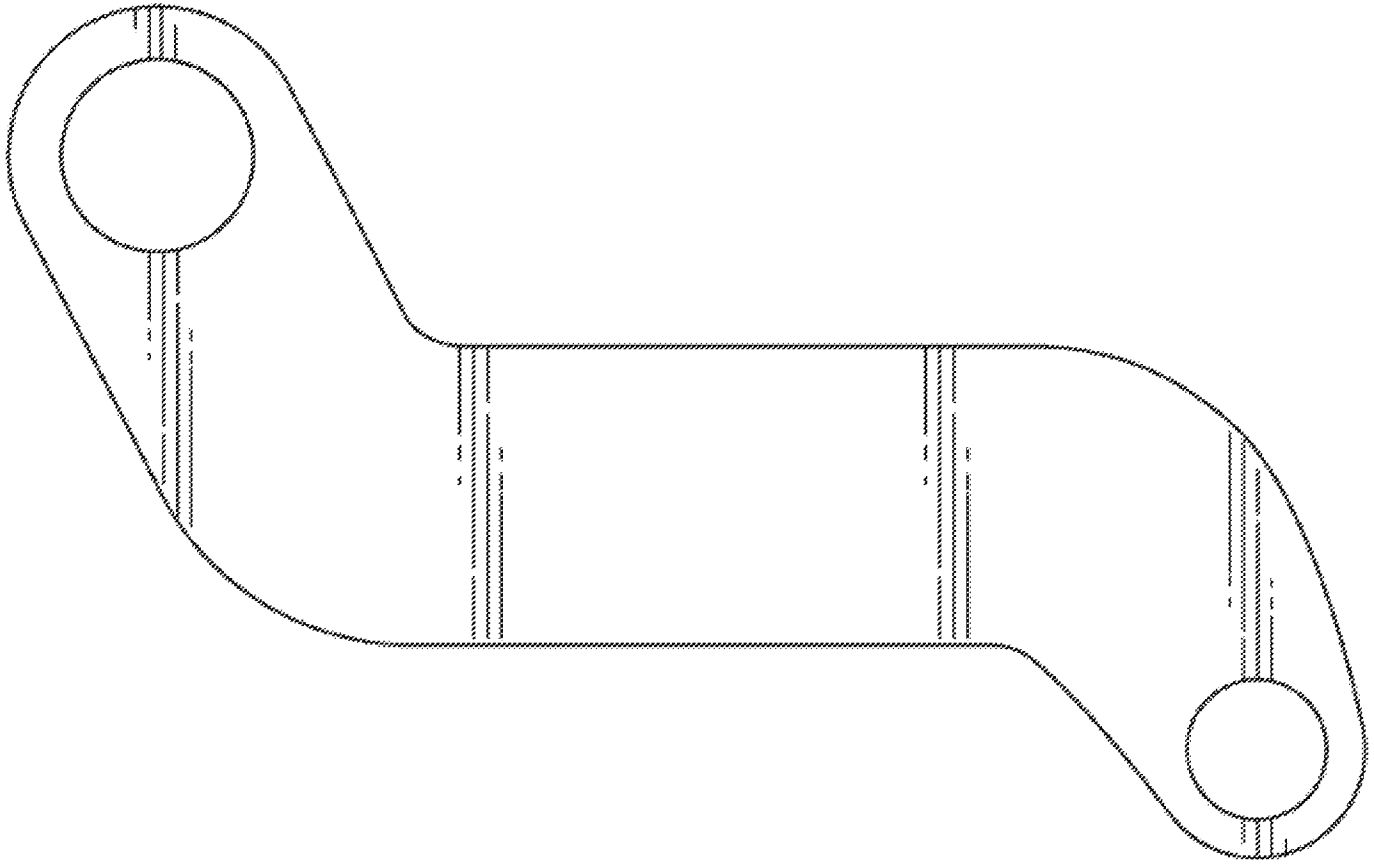
FIG. 15 illustrates a top view of the fifth embodiment of a cup holder.

FIG. 14 illustrates a perspective view of a fifth embodiment of a cup holder. FIG. 15 illustrates a top view of the fifth embodiment of a cup holder. In cup holder 120, according to the fifth embodiment, each of the holding portion, stabilizing portion, and second stabilizing portion have straight edges.

Figure 16:
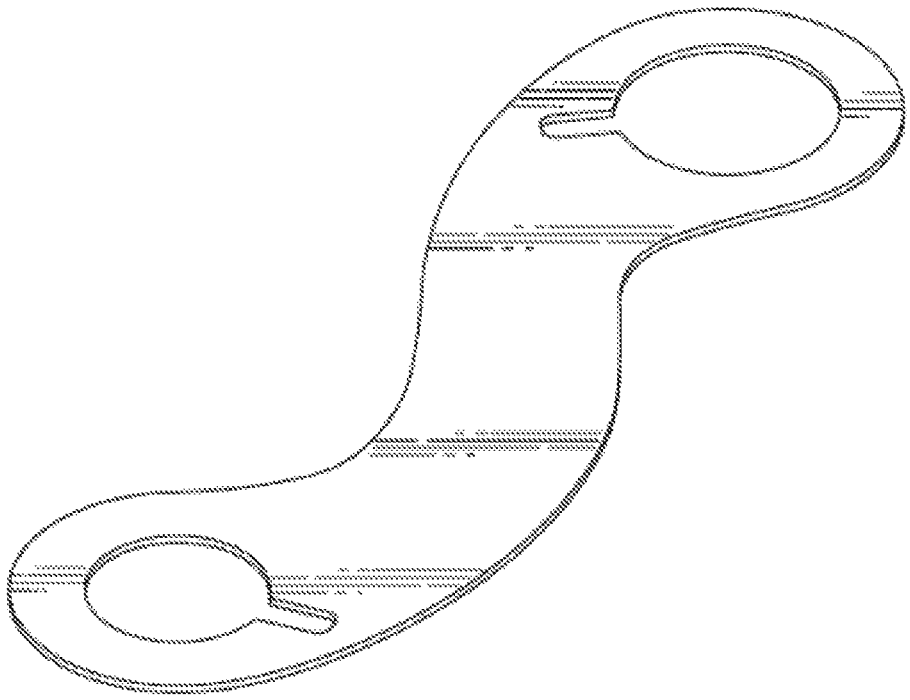
FIG. 16 illustrates a perspective view of a sixth embodiment of a cup holder.
Figure 17:
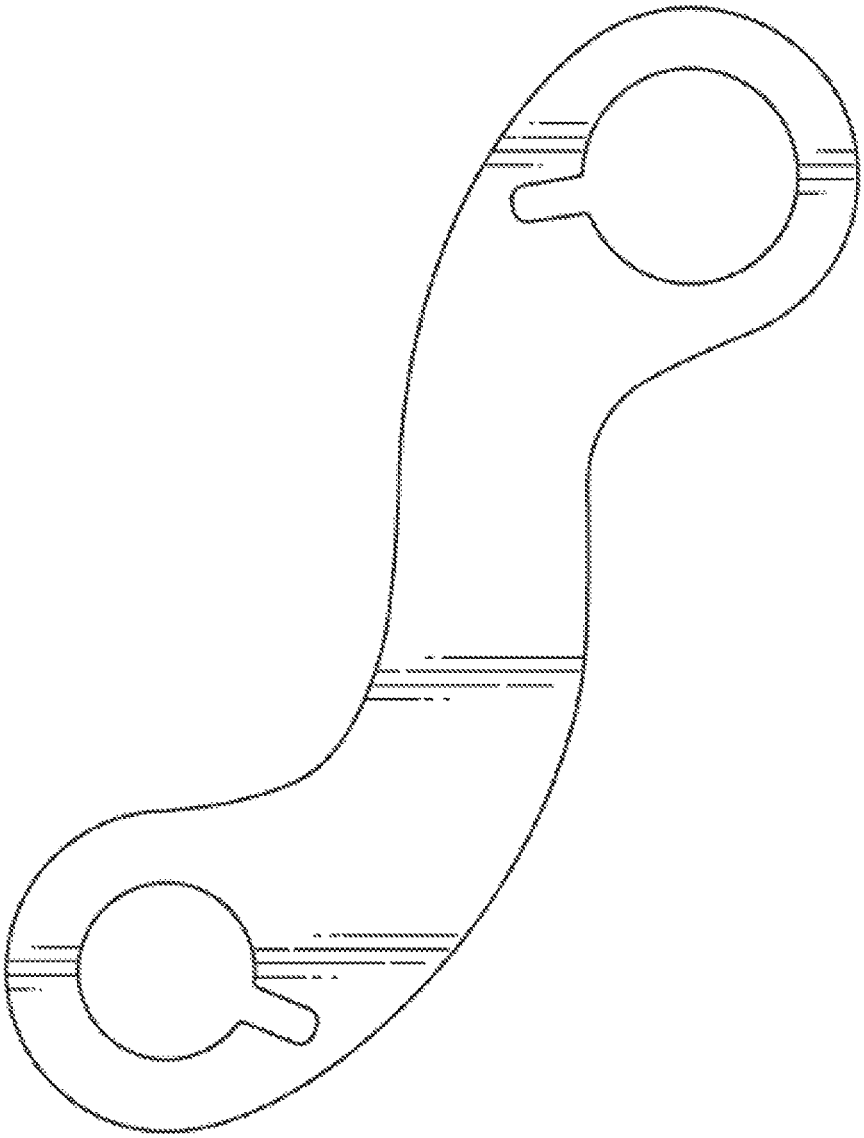
FIG. 17 illustrates a top view of the sixth embodiment of a cup holder.

FIG. 16 illustrates a perspective view of a sixth embodiment of a cup holder. FIG. 17 illustrates a top view of the fifth embodiment of a cup holder. In cup holder 120, according to the fifth embodiment, each of the holding portion, stabilizing portion, and second stabilizing portion have curved edges.

Figure 18:
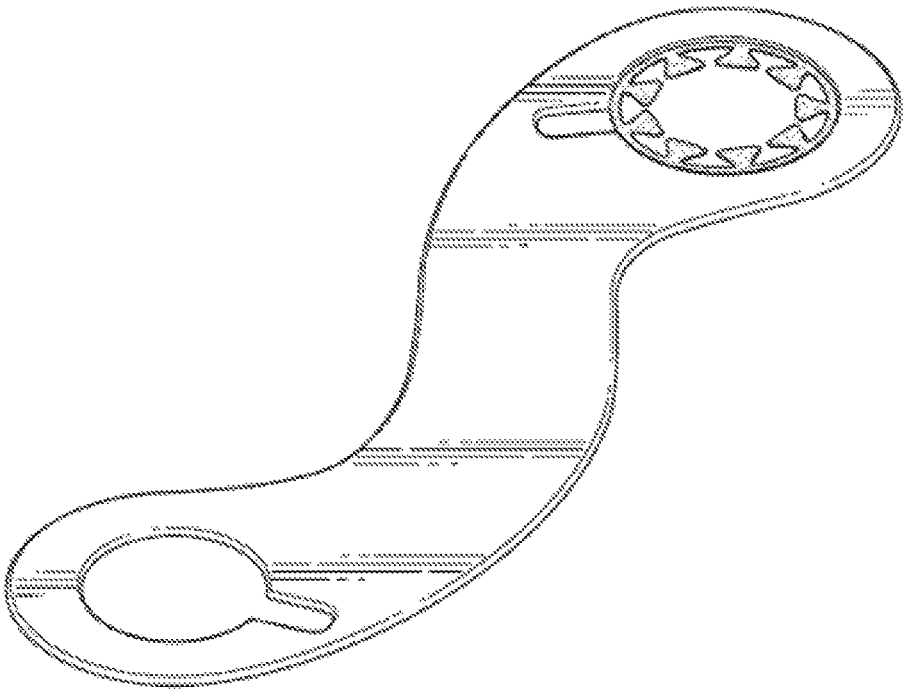
FIG. 18 illustrates a perspective view of a seventh embodiment of a cup holder.
Figure 19:
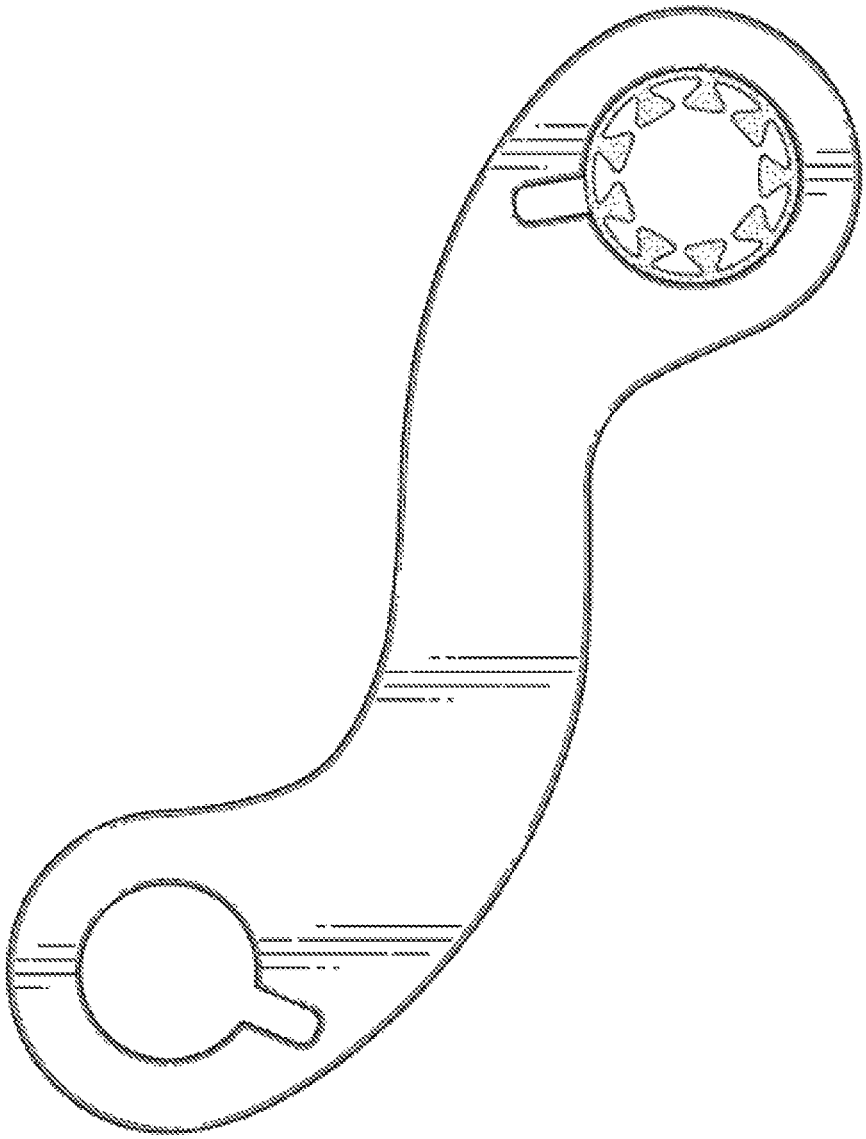
FIG. 19 illustrates a top view of the seventh embodiment of a cup holder.

FIG. 18 illustrates a perspective view of a seventh embodiment of a cup holder. FIG. 19 illustrates a top view of the seventh embodiment of a cup holder. As shown in FIGS. 18 and 19, one or more of the apertures of the cup holder 120 may include a rubber grommet. The rubber grommet beneficially allows a beverage container 130 to be more securely held. In some embodiments, the rubber grommet is detachable from the cup holder 120. The rubber grommet show in FIGS. 18 and 19 may be used in any of the embodiments described hereinabove.

Additional Configuration Considerations

Throughout this specification, plural instances may implement components, operations, or structures described as a single instance. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation, and details of the method and apparatus disclosed herein without departing from the spirit and scope defined in the appended claims.

What is claimed is:

1. A beverage container holder comprising:

a holding portion elongated in a first direction, the holding portion having a flat profile and including an aperture configured to hold a beverage container;

a first stabilizing portion elongated in a second direction, the first stabilizing portion coupled to the holding portion, the second direction different than the first direction, wherein the first direction and the second direction form an obtuse angle, the first stabilizing portion having a flat profile and configured to be placed between a seating surface of a furniture for sitting and a frame of the furniture for sitting, wherein the first stabilizing portion is removable from the furniture for sitting, and a second stabilizing portion elongated in a third direction, the third direction different than the second direction, the second stabilizing portion having a flat profile and configured to be placed between the seating surface of the furniture for sitting and the frame of the furniture for sitting, wherein the first stabilizing portion is coupled to the holding portion at a first end of the first stabilizing portion, and the first stabilizing portion is coupled to the second stabilizing portion at a second end of the first stabilizing portion, the second end opposite to the first end, wherein the beverage container holder is configured to be flipped over such that a first surface of the holding portion is facing up when the beverage container holder is configured to hold the beverage container on a right side of a seated user, and such that a second surface of the holding portion, opposite to the first surface, is facing up when the beverage container holder is configured to hold the beverage container on a left side of the seated user.

2. The beverage container holder of claim 1, wherein the furniture for sitting is a couch.

3. The beverage container holder of claim 2, wherein the stabilizing portion is configured to be placed between a cushion of the couch and a frame of the couch.

4. The beverage container holder of claim 1, wherein the second stabilizing portion includes a second aperture, the second aperture having a radius different than a radius of the aperture of the holding portion, and wherein the holding portion is configured to be placed between the seating surface of the furniture for sitting and the frame of the furniture for sitting when a beverage container is being held by the second aperture instead of the aperture of the holding portion.

5. The beverage container holder of claim 1, wherein the third direction is parallel to the first direction.

6. The beverage container holder of claim 1, wherein the stabilizing portion includes a second aperture, the second aperture having a radius different than a radius of the aperture of the holding portion, and wherein the holding portion is configured to be placed between the seating surface of the furniture for sitting and the frame of the furniture for sitting when a beverage container is being held by the second aperture instead of the aperture of the holding portion.

7. The beverage container holder of claim 1, wherein the first aperture includes a rubber grommet.

8. The beverage container holder of claim 1, wherein the holding portion and the stabilizing portion have straight edges.

9. The beverage container holder of claim 1, wherein the holding portion and the stabilizing portion have rounded edges.

10. The beverage container holder of claim 1, wherein the holding portion and the stabilizing portion are a unibody structure.

11. The beverage container holder of claim 1, wherein the holding portion and the stabilizing portion are made of a sturdy material.

12. The beverage container holder of claim 1, wherein the holding portion and the stabilizing portion are made of a flexible material.

13. The beverage container holder of claim 1, wherein the first direction, the second direction, and the third direction are coplanar.

14. The beverage container holder of claim 1, wherein the second direction and the third direction form a second obtuse angle.

15. The beverage container holder of claim 1, wherein the stabilizing portion is longer than the holding portion.

16. The beverage container holder of claim 1, wherein the beverage container holder is configured to be flipped over such that the stabilizing portion is configured to be pointing towards the seating user regardless of whether the seating user is using the beverage container holder to hold the beverage container on the right side or the left side of the seating user.

17. The beverage container holder of claim 1, wherein the stabilizing portion is configured to point away from a right armrest of the furniture for sitting when the sitting user is using the beverage container holder to hold the beverage container on the right side of the seating user, and wherein the stabilizing portion is configured to point away from a left armrest of the furniture for sitting when the sitting user is using the beverage container holder to hold the beverage container on the left side of the seating user.

18. The beverage container holder of claim 1, wherein the holding portion is configured to wrap around a right armrest of the furniture for sitting when the sitting user is using the beverage container holder to hold the beverage container on the right side of the seating user, and wherein the holding portion is configured to wrap around a left armrest of the furniture for sitting when the sitting user is using the beverage container holder to hold the beverage container on the left side of the seating user.

* * * * *